US005742689A

United States Patent [19]

Tucker et al.

[11] Patent Number: 5,742,689

[45] Date of Patent: Apr. 21, 1998

[54] METHOD AND DEVICE FOR PROCESSING A MULTICHANNEL SIGNAL FOR USE WITH A HEADPHONE

[75] Inventors: Timothy John Tucker, Gainesville; David M. Green, East Palatka, both of Fla.

[73] Assignee: Virtual Listening Systems, Inc., Gainesville, Fla.

[21] Appl. No.: 582,830

[22] Filed: Jan. 4, 1996

[51] Int. Cl.[6] ..... H04S 5/00

[52] U.S. Cl. ..... 381/17; 381/25

[58] Field of Search ..... 381/17, 25

[56] References Cited

U.S. PATENT DOCUMENTS

| | | | |
|---|---|---|---|
| 4,097,689 | 6/1978 | Yamada et al. . | |
| 4,388,494 | 6/1983 | Schöne et al. . | |
| 5,173,944 | 12/1992 | Begault . | |
| 5,371,799 | 12/1994 | Lowe et al. . | |
| 5,386,082 | 1/1995 | Higashi . | |
| 5,404,406 | 4/1995 | Fuchigami et al. . | |
| 5,436,975 | 7/1995 | Lowe et al. . | |
| 5,438,623 | 8/1995 | Begault . | |
| 5,440,639 | 8/1995 | Suzuki et al. . | |
| 5,459,790 | 10/1995 | Scofield et al. | 381/25 |
| 5,521,981 | 5/1996 | Gehring | 381/17 |

FOREIGN PATENT DOCUMENTS 9523493 8/1995 WIPO .

OTHER PUBLICATIONS

Wightman, F., D. Kistler (1993) "Multidimensional sealing analysis of head–related transfer function" Proceedings of IEEE Workshop on Applications of Signal Processing to Audio and Acoustics, pp. 98–101.

*Primary Examiner*—Forester W. Isen

*Attorney, Agent, or Firm*—Gerard H. Bencen, P.A.; Gerald H. Bencen, Esq.

[57] ABSTRACT

A method and device processes multi-channel audio signals, each channel corresponding to a loudspeaker placed in a particular location in a room, in such a way as to create, over headphones, the sensation of multiple "phantom" loudspeakers placed throughout the room. Head Related Transfer Functions (HRTFs) are chosen according to the elevation and azimuth of each intended loudspeaker relative to the listener, each channel being filtered with an HRTF such that when combined into left and right channels and played over headphones, the listener senses that the sound is actually produced by phantom loudspeakers placed throughout the "virtual" room. A database collection of sets of HRTF coefficients from numerous individuals and subsequent matching of the best HRTF set to the individual listener provides the listener with listening sensations similar to that which the listener, as an individual, would experience when listening to multiple loudspeakers placed throughout the room. An appropriate transfer function applied to the right and left channel output allows the sensation of open-ear listening to be experienced through closed-ear headphones.

9 Claims, 19 Drawing Sheets

| | Jane | Susan | Paul | Tom | Ed | Sid | Mary | Kate |
|---|---|---|---|---|---|---|---|---|
| Listener 1 | 90 | 85 | 62 | 55 | 68 | 32 | 83 | 70 |
| Listener 2 | 45 | 47 | 68 | 52 | 78 | 67 | 43 | 56 |
| Listener 3 | 55 | 56 | 71 | 45 | 62 | 55 | 66 | 72 |
| Listener 4 | 86 | 63 | 82 | 40 | 40 | 45 | 65 | 57 |
| Listener 5 | 40 | 35 | 25 | 20 | 56 | 53 | 36 | 28 |
| Listener 6 | 48 | 35 | 58 | 54 | 69 | 73 | 32 | 44 |

FIG. 8

| | HRTF Location 1 | | | | HRTF Location 2 | | | | ... | HRTF Location L | | |
|---|---|---|---|---|---|---|---|---|---|---|---|---|
| Subject | Band 1 | Band 2 | ... | Band N | Band 1 | Band 2 | ... | Band N | ... | Band 1 | Band 2 | Band N |
| 1 right | | | | | | | | | | | | |
| 1 left | | | | | | | | | | | | |
| 2 right | | | | | | | | | | | | |
| 2 left | | | | | | | | | | | | |
| ... | | | | | | | | | | | | |
| S right | | | | | | | | | | | | |
| S left | | | | | | | | | | | | |

FIG. 13

METHOD AND DEVICE FOR PROCESSING A MULTICHANNEL SIGNAL FOR USE WITH A HEADPHONE

FIELD OF THE INVENTION

The present invention relates to a method and device for processing a multi-channel audio signal for reproduction over headphones. In particular, the present invention relates to an apparatus for creating, over headphones, the sensation of multiple "phantom" loudspeakers in a virtual listening environment.

Background Information

In an attempt to provide a more realistic or engulfing listening experience in the movie theater, several companies have developed multi-channel audio formats. Each audio channel of the multi-channel signal is routed to one of several loudspeakers distributed throughout the theater, providing movie-goers with the sensation that sounds are originating all around them. At least one of these formats, for example the Dolby Pro Logic® format, has been adapted for use in the home entertainment industry. The Dolby Pro Logic® format is now in wide use in home theater systems. As with the theater version, each audio channel of the multi-channel signal is routed to one of several loudspeakers placed around the room, providing home listeners with the sensation that sounds are originating all around them. As the home entertainment system market expands, other multi-channel systems will likely become available to home consumers.

When humans listen to sounds produced by loudspeakers, it is termed free-field listening. Free-field listening occurs when the ears are uncovered. It is the way we listen in everyday life. In a free-field environment, sounds arriving at the ears provide information about the location and distance of the sound source. Humans are able to localize a sound to the right or left based on arrival time and sound level differences discerned by each ear. Other subtle differences in the spectrum of the sound as it arrives at each ear drum help determine the sound source elevation and front/back location. These differences are related to the filtering effects of several body parts, most notably the head and the pinna of the ear. The process of listening with a completely unobstructed ear is termed open-ear listening.

The process of listening while the outer surface of the ear is covered is termed closed-ear listening. The resonance characteristics of open-ear listening differ from those of closed-ear listening. When headphones are applied to the ears, closed-ear listening occurs. Due to the physical effects on the head and ear from wearing headphones, sound delivered through headphones lacks the subtle differences in time, level, and spectra caused by location, distance, and the filtering effects of the head and pinna experienced in open-ear listening. Thus, when headphones are used with multi-channel home entertainment systems, the advantages of listening via numerous loudspeakers placed throughout the room are lost, the sound often appearing to be originating inside the listener's head, and further disruption of the sound signal is caused by the physical effects of wearing the headphones.

There is a need for a system that can process multi-channel audio in such a way as to cause the listener to sense multiple "phantom" loudspeakers when listening over headphones. Such a system should process each channel such that the effects of loudspeaker location and distance intended to be created by each channel signal, as well as the filtering effects of the listener's head and pinnae, are introduced.

An object of the present invention is to provide a method for processing the multi-channel output typically produced by home entertainment systems such that when presented over headphones, the listener experiences the sensation of multiple "phantom" loudspeakers placed throughout the room.

Another object of the present invention is to provide an apparatus for processing the multi-channel output typically produced by home entertainment systems such that when presented over headphones, the listener experiences listening sensations most like that which the listener, as an individual, would experience when listening to multiple loudspeakers placed throughout the room.

Yet another object of the present invention is to provide an apparatus for processing the multi-channel output typically produced by home entertainment systems such that when presented over headphones, the listener experiences sensations typical of open-ear (unobstructed) listening.

SUMMARY OF THE INVENTION

According to the present invention, multiple channels of an audio signal are processed through the application of filtering using a head related transfer function (HRTF) such that when reduced to two channels, left and right, each channel contains information that enables the listener to sense the location of multiple phantom loudspeakers when listening over headphones.

Also according to the present invention, multiple channels of an audio signal are processed through the application of filtering using HRTFs chosen from a large database such that when listening through headphones, the listener experiences a sensation that most closely matches the sensation the listener, as an individual, would experience when listening to multiple loudspeakers.

In another exemplary embodiment of the present invention, the right and left channels are filtered in order to simulate the effects of open-ear listening.

FIG. **6*a*** is a schematic in block diagram form of HRTF filtering as applied to a single channel according to an exemplary embodiment of the present invention.

FIG. **6*b*** is a schematic in block diagram form of the process of HRTF matching based on listener performance ranking according to the present invention.

FIG. **6*c*** is a schematic in block diagram form of the process of HRTF matching based on HRTF cluster according to the present invention.

Figure 7:
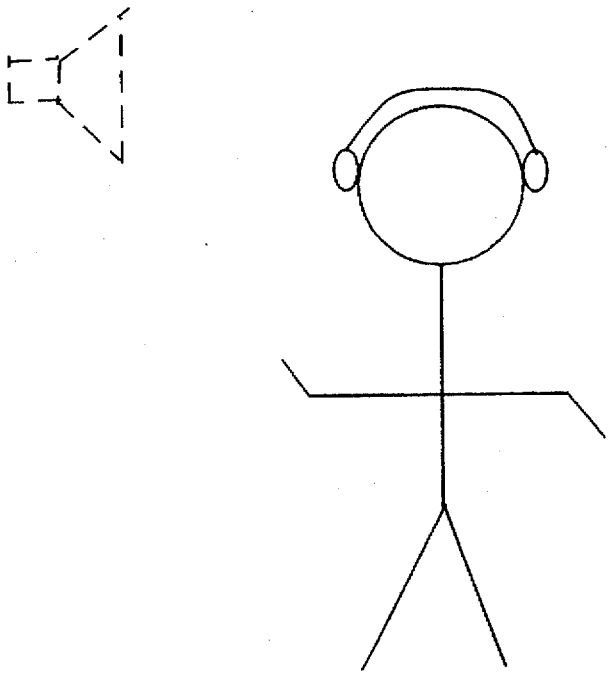

FIG. 7 illustrates the process of assessing a listener's ability to localize elevation over headphones for a given set of HRTFs according to an exemplary embodiment of the present invention.

FIG. 8 shows a sample HRTF performance matrix calculated in an exemplary embodiment of the present invention.

Figure 9:
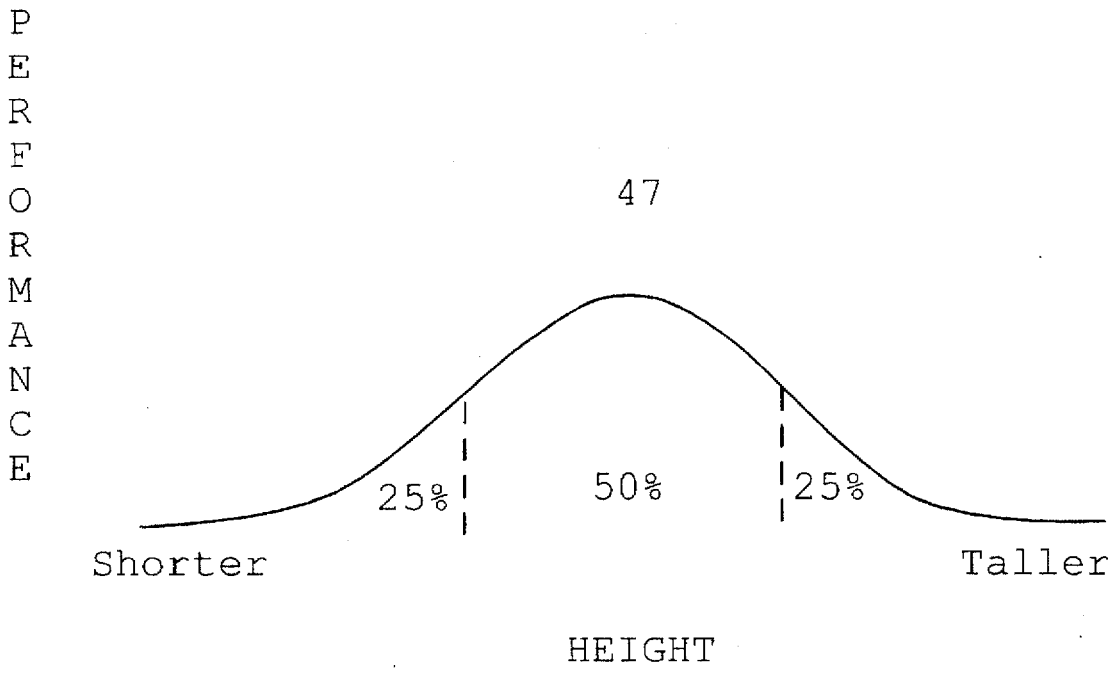

FIG. 9 illustrates HRTF rank-ordering based on performance and height according to an exemplary embodiment of the present invention.

Figure 10:
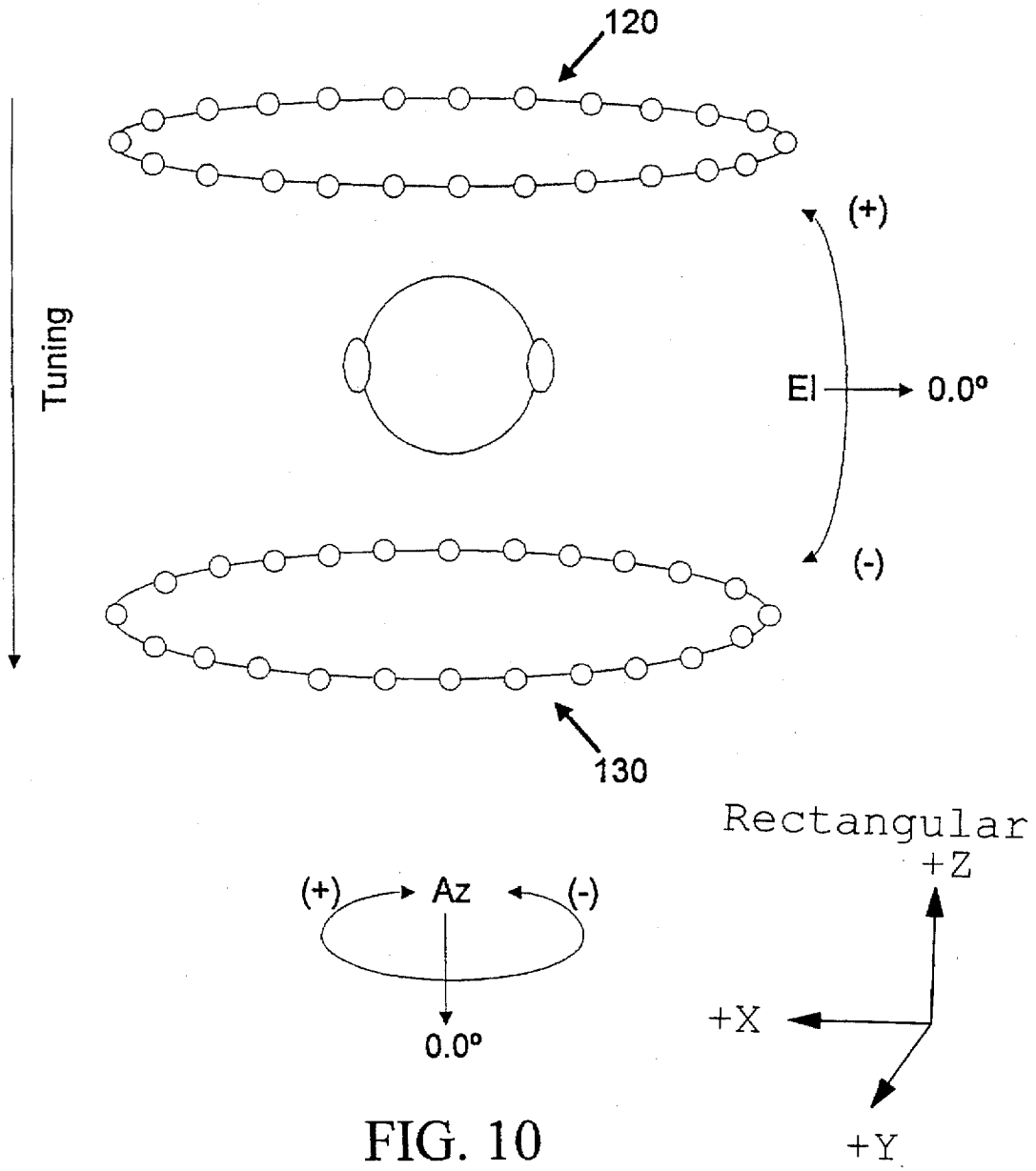

FIG. 10 depicts an HRTF matching process according to the present invention.

Figure 11:
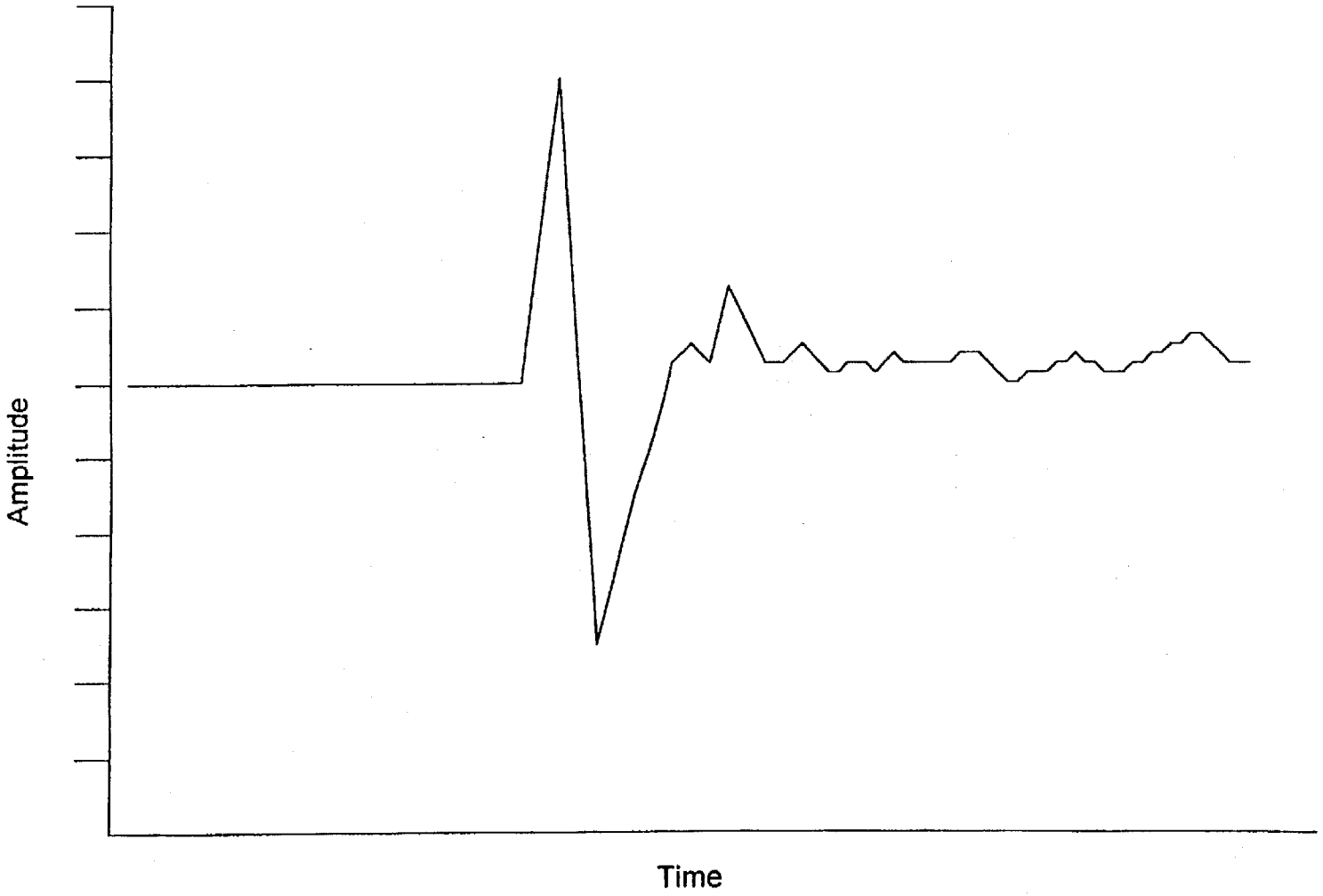

FIG. 11 shows a raw HRTF recorded from one individual at one spatial location for one ear.

Figure 12:
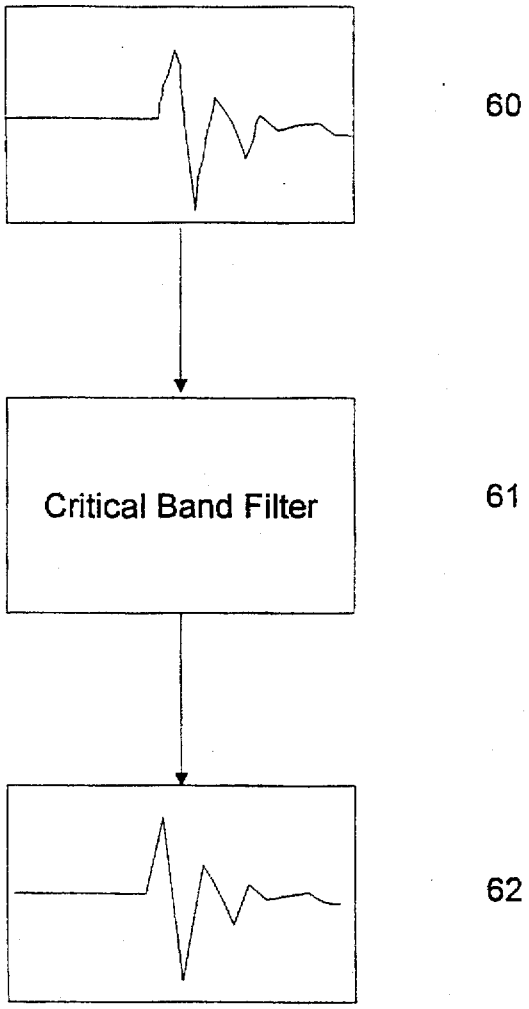

FIG. 12 illustrates critical band filtering according to the present invention.

FIG. 13 illustrates an exemplary subject filtered HRTF matrix according to the present invention.

Figure 14:
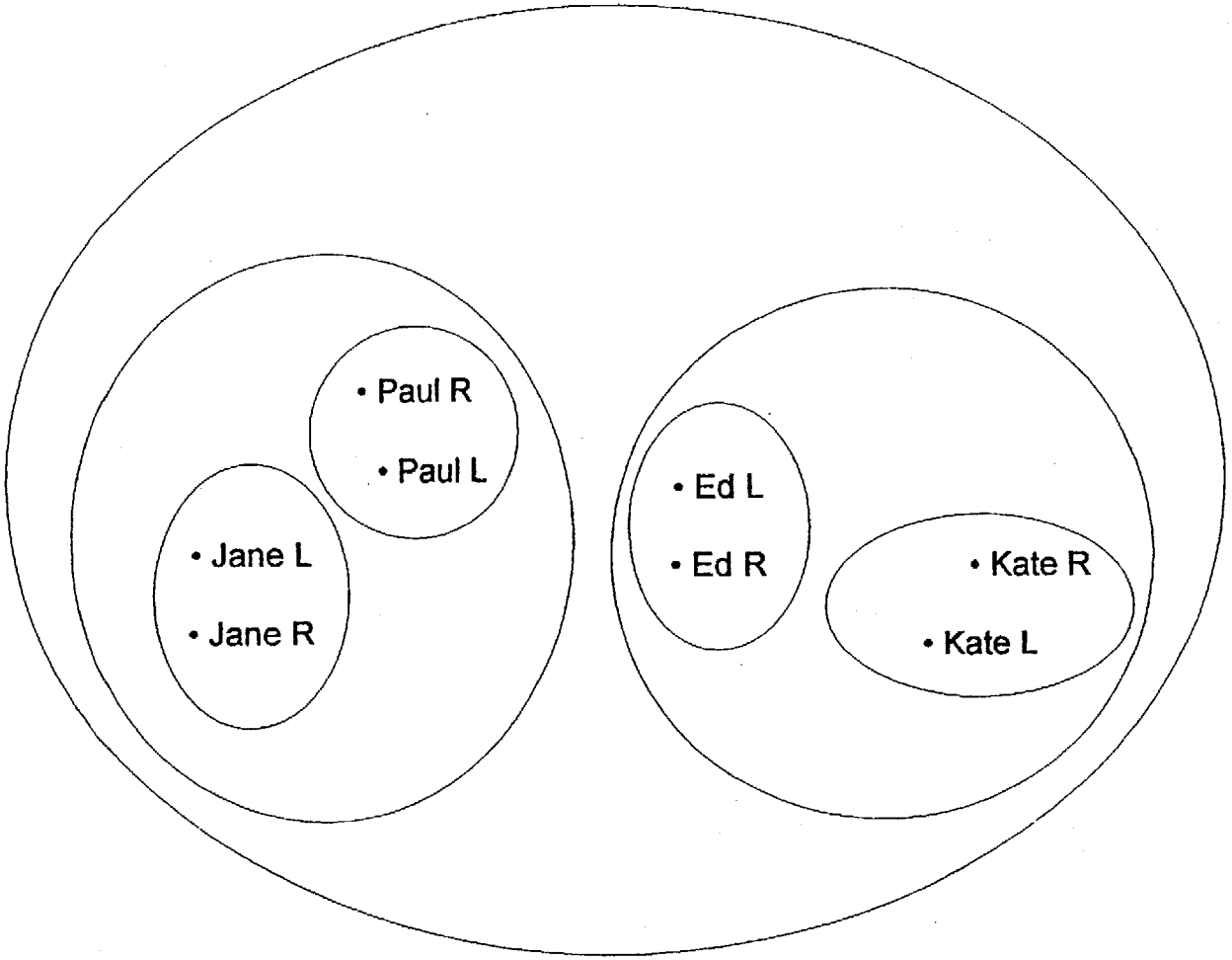

FIG. 14 illustrates a hypothetical hierarchical agglomerative clustering procedure in two dimensions according to the present invention.

Figure 15:
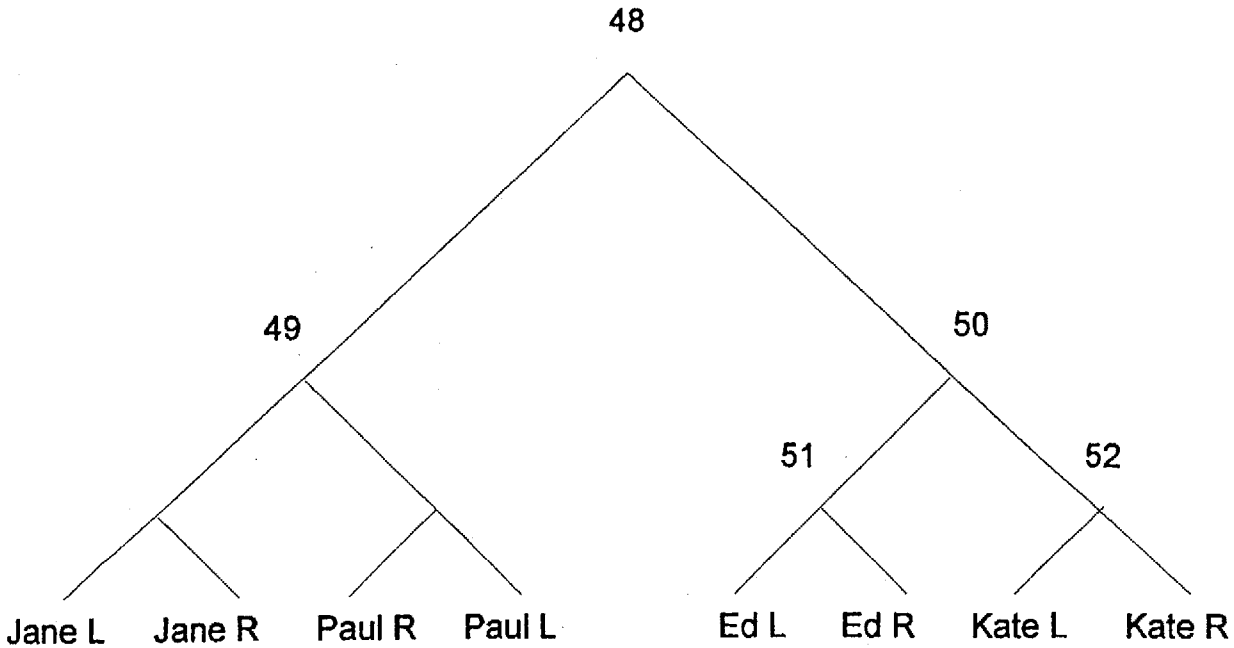

FIG. 15 illustrates a hypothetical hierarchical agglomerative clustering procedure according to an exemplary embodiment of the present invention.

Figure 16:
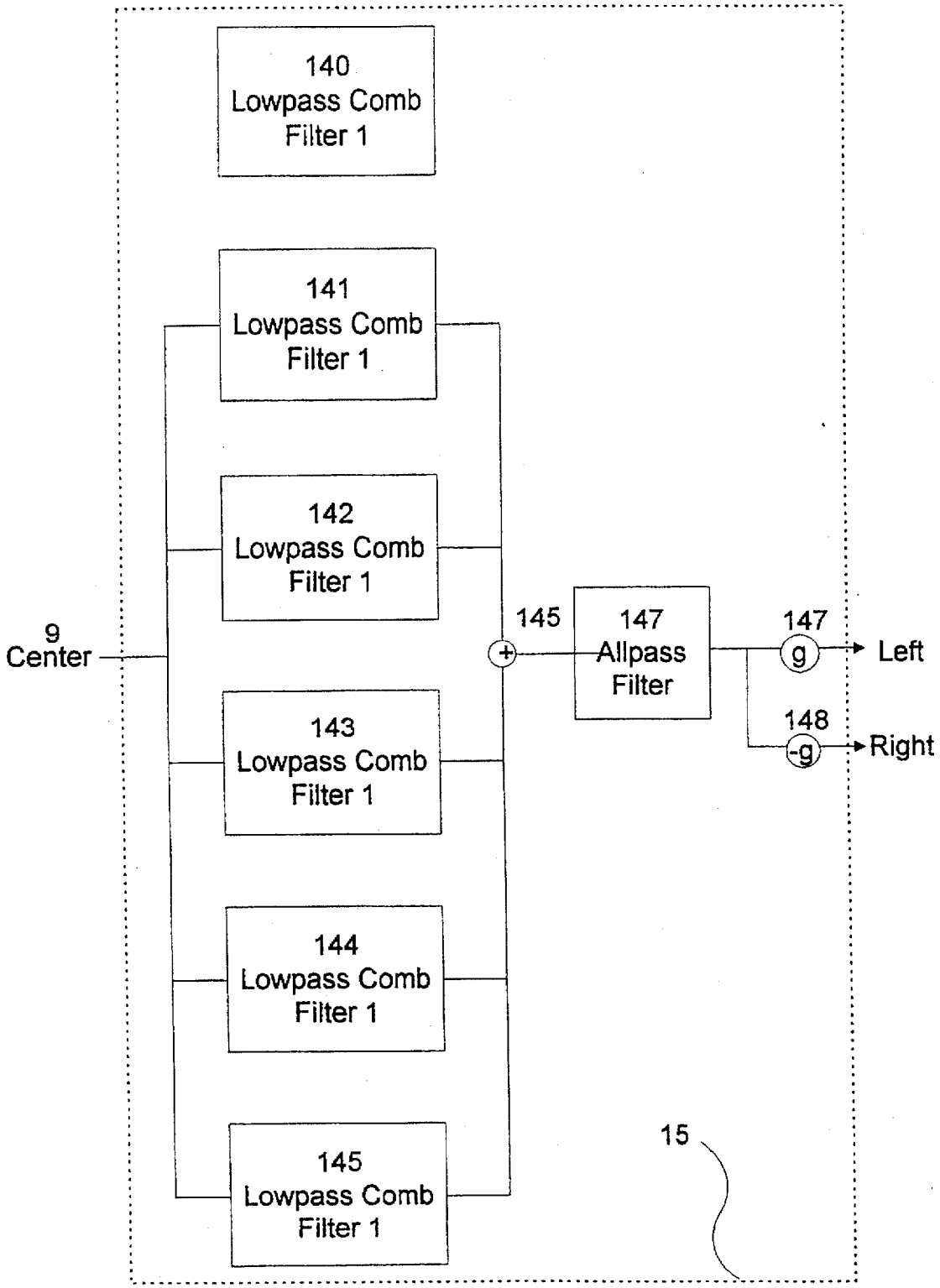

FIG. 16 is a schematic in block diagram form of a typical reverberation processor constructed of parallel lowpass comb filters.

Figure 17:
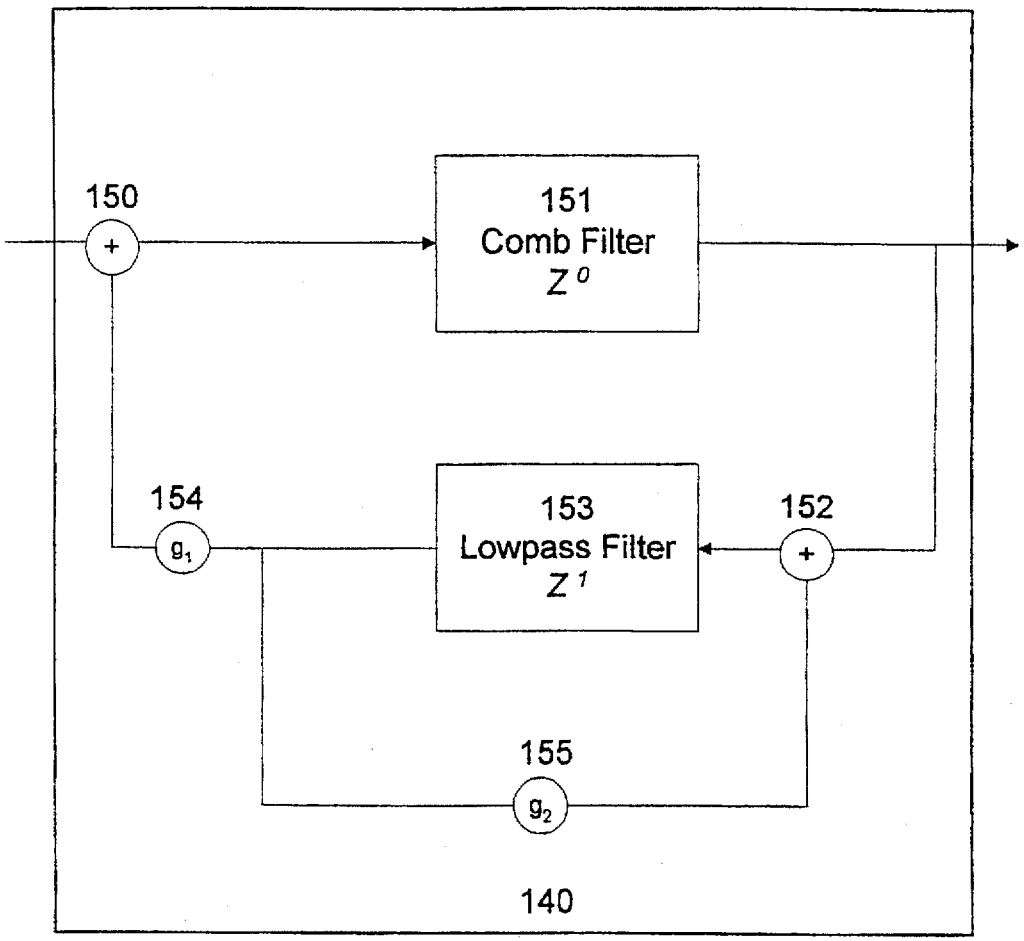

FIG. 17 is a schematic in block diagram of a typical lowpass comb filter.

DETAILED DESCRIPTION OF THE INVENTION

The method and device according to the present invention process multi-channel audio signals having a plurality of channels, each corresponding to a loudspeaker placed in a particular location in a room, in such a way as to create, over headphones, the sensation of multiple "phantom" loudspeakers placed throughout the room. The present invention utilizes Head Related Transfer Functions (HRTFs) that are chosen according to the elevation and azimuth of each intended loudspeaker relative to the listener, each channel being filtered by a set of HRTFs such that when combined into left and right channels and played over headphones, the listener senses that the sound is actually produced by phantom loudspeakers placed throughout the "virtual" room.

The present invention also utilizes a database collection of sets of HRTFs from numerous individuals and subsequent matching of the best HRTF set to the individual listener, thus providing the listener with listening sensations similar to that which the listener, as an individual, would experience when listening to multiple loudspeakers placed throughout the room. Additionally, the present invention utilizes an appropriate transfer function applied to the right and left channel output so that the sensation of open-ear listening may be experienced through closed-ear headphones.

Figure 1:
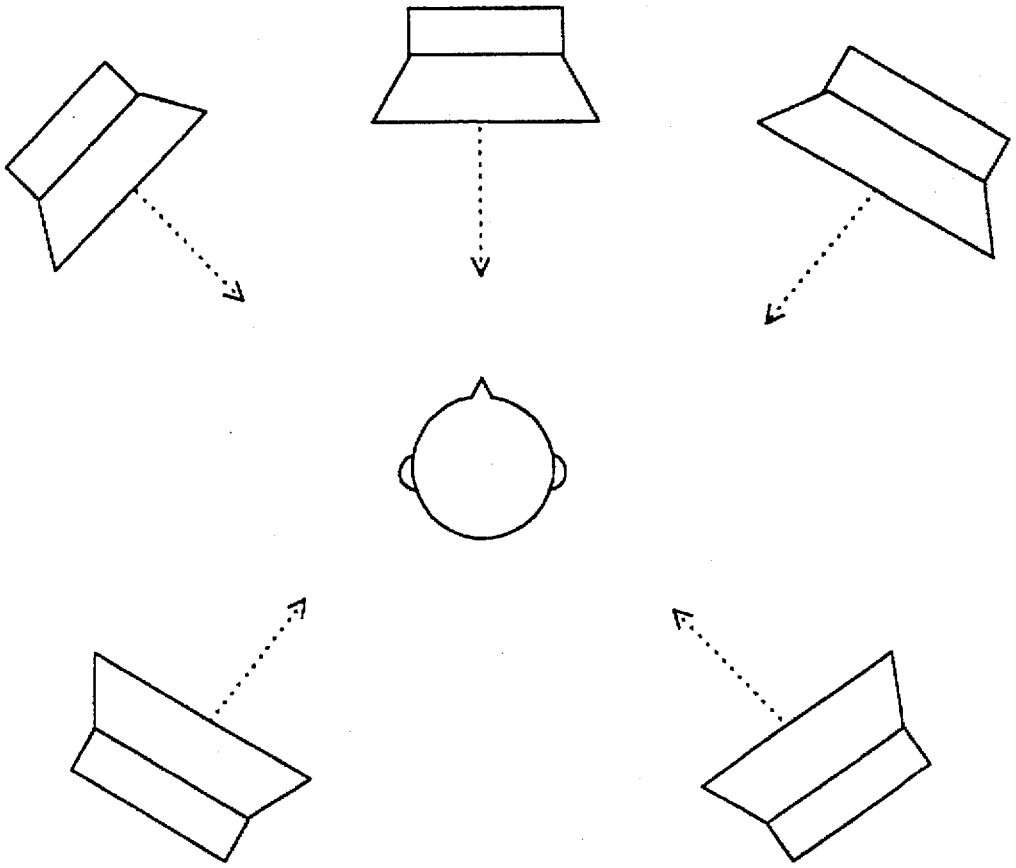
FIG. 1 is a representation of sound waves received at both ears of a listener sitting in a room with a typical multi-channel loud loudspeaker configuration.

FIG. 1 depicts the path of sound waves received at both ears of a listener according to a typical embodiment of a home entertainment system. The multi-channel audio signal is decoded into multiple channels, i.e., a two-channel encoded signal is decoded into a multi-channel signal in accordance with, for example, the Dolby Pro Logic® format. Each channel of the multi-channel signal is then played, for example, through its associated loudspeaker, e.g., one of five loudspeakers: left; right; center; left surround; and right surround. The effect is the sensation that sound is originating all around the listener.

Figure 2:
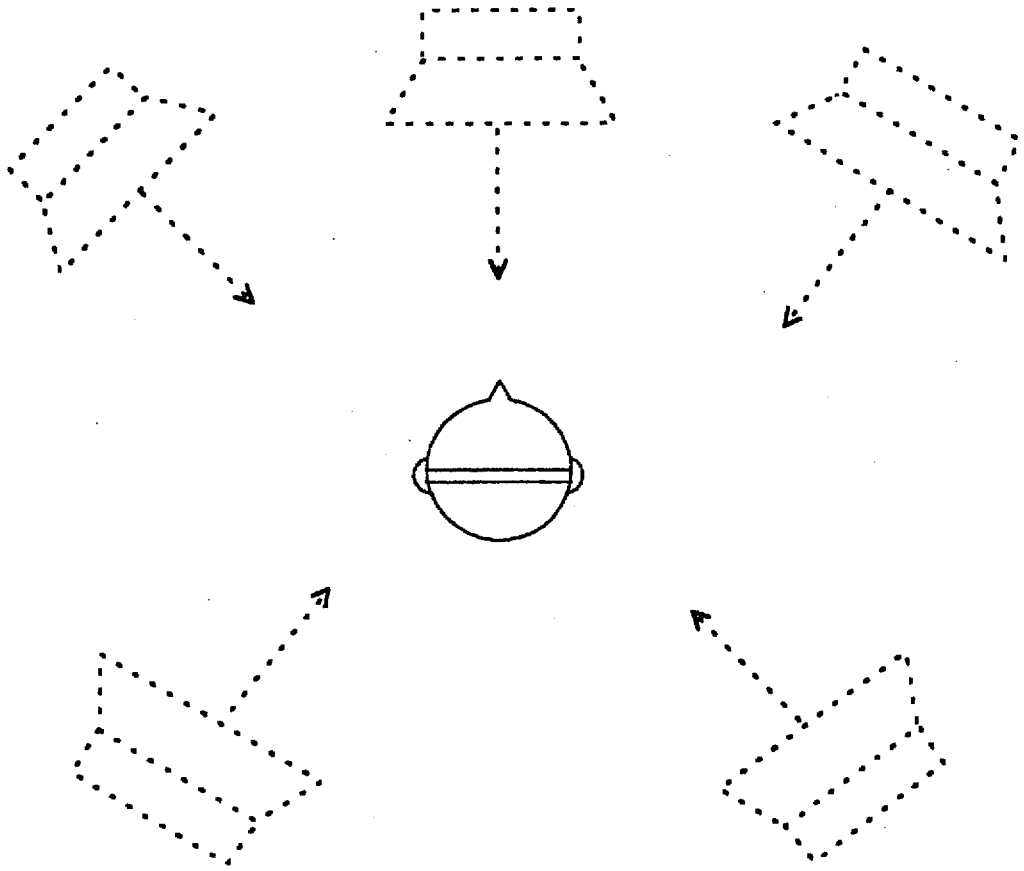
FIG. 2 is a representation of the listening sensation experienced through headphones according to an exemplary embodiment of the present invention.

FIG. 2 depicts the listening experience created by an exemplary embodiment of the present invention. As described in detail with respect to FIG. 4, the present invention processes each channel of a multi-channel signal using a set of HRTFs appropriate for the distance and location of each phantom loudspeaker (e.g., the intended loudspeaker for each channel) relative to the listener's left and right ears. All resulting left ear channels are summed, and all resulting right ear channels are summed producing two channels, left and right. Each channel is then preferably filtered using a transfer function that introduces the effects of open-ear listening. When the two channel output is presented via headphones, the listener senses that the sound is originating from five phantom loudspeakers placed throughout the room, as indicated in FIG. 2.

The manner in which the ears and head filter sound may be described by a Head Related Transfer Function (HRTF). An HRTF is a transfer function obtained from one individual for one ear for a specific location. An HRTF is described by multiple coefficients that characterize how sound produced at various spatial positions should be filtered to simulate the filtering effects of the head and outer ear. HRTFs are typically measured at various elevations and azimuths. Typical HRTF locations are illustrated in FIG. 3.

Figure 3:
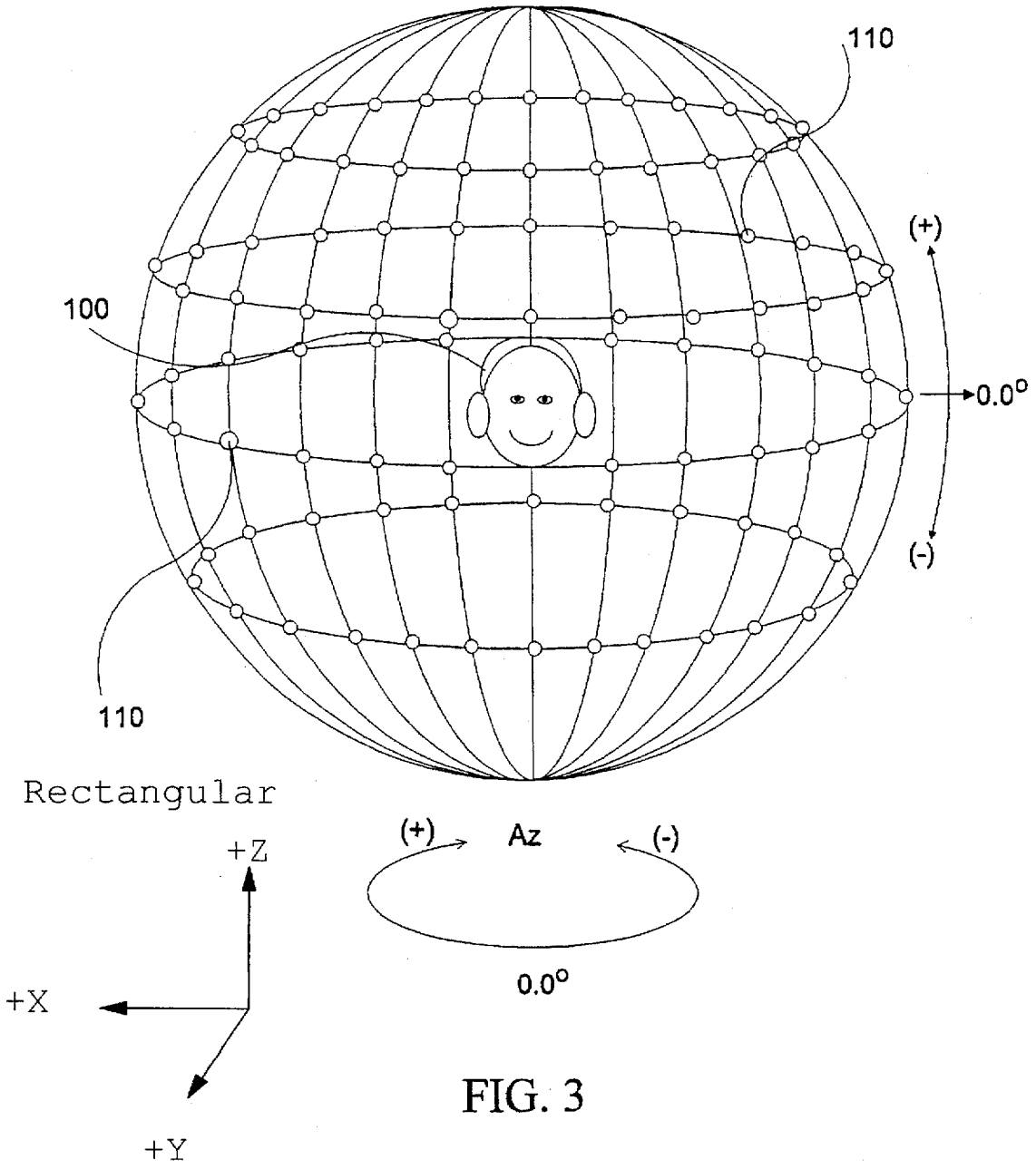
FIG. 3 shows a set of head related transfer functions (HRTFs) obtained at multiple elevations and azimuths surrounding a listener.

In FIG. 3, the horizontal plane located at the center of the listener's head 100 represents 0.0° elevation. The vertical plane extending forward from the center of the head 100 represents 0.0° azimuth. HRTF locations are defined by a pair of elevation and azimuth coordinates and are represented by a small sphere 110. Associated with each sphere 110 is a set of HRTF coefficients that represent the transfer function for that sound source location. Each sphere 110 is actually associated with two HRTFs, one for each ear.

Because no two humans are the same, no two HRTFs are exactly alike. The present invention utilizes a database of HRTFs that has been collected from a pre-measured group of the general population. For example, the HRTFs are collected from numerous individuals of both sexes with varying physical characteristics. The present invention then employs a unique process whereby the sets of HRTFs obtained from all individuals are organized into an ordered fashion and stored in a read only memory (ROM) or other storage device. An HRTF matching processor enables each user to select, from the sets of HRTFs stored in the ROM, the set of HRTFs that most closely matches the user.

Figure 4:
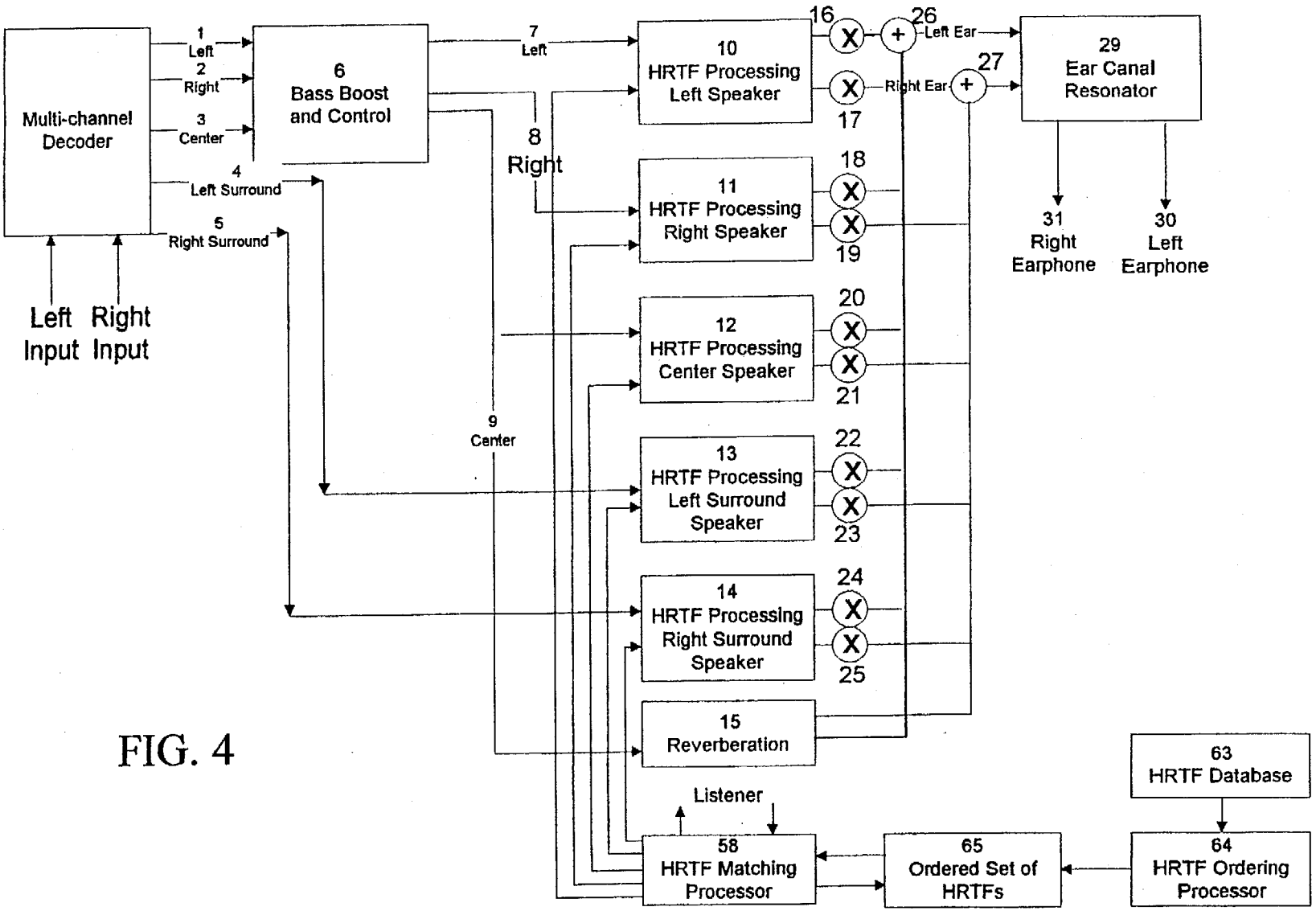
FIG. 4 is a schematic in block diagram form of a typical multi-channel headphone processing system according to an exemplary embodiment of the present invention.

An exemplary embodiment of the present invention is illustrated in FIG. 4. After the multi-channel signal has been decoded into its constituent channels, for example channels 1, 2, 3, 4 and 5 in the Dolby Pro Logic® format, selected channels are processed via an optional bass boost circuit 6. For example, channels 1, 2 and 3 are processed by the bass boost circuit 6. Output channels 7, 8 and 9 from the bass boost circuit 6, as well as channels 4 and 5, are then each electronically processed to create the sensation of a phantom loudspeaker for each channel.

Processing of each channel is accomplished through digital filtering using sets of HRTF coefficients, for example via HRTF processing circuits 10, 11, 12, 13 and 14. The HRTF processing circuits can include, for example, a suitably programmed digital signal processor. A best match between the listener and a set of HRTFs is selected via the HRTF matching processor 59. Based on the best match set of HRTFs, a preferred pair of HRTFs, one for each ear, is selected for each channel as a function of the intended loudspeaker position of each channel of the multi-channel signal. In an exemplary embodiment of the present invention, the best match set of HRTFs are selected from an ordered set of HRTFs stored in ROM 65 via the HRTF matching processor 59 and routed to the appropriate HRTF processor 10, 11, 12, 13 and 14.

Prior to the listener selecting a best match set of HRTFs, sets of HRTFs stored in the HRTF database 63 are processed by an HRTF ordering processor 64 such that they may be stored in ROM 65 in an order sequence to optimize the matching process via HRTF matching processor 59. Once the optimal pair of HRTFs have been selected by the listener, separate HRTFs are applied for the right and left ears, converting each input channel to dual channel output.

Each channel of the dual channel output from, for example, the HRTF processing circuit 10 is multiplied by a scaling factor as shown, for example, at nodes 16 and 17. This scaling factor reflects signal attenuation as a function of the distance between the phantom loudspeaker and the listener's ear. All right ear channels are summed at node 26. All left ear channels are summed at node 27. The output of nodes 26 and 27 results in two channels, left and right respectively, each of which contains signal information necessary to provide the sensation of left, right, center, and rear loudspeakers intended to be created by each channel of the multi-channel signal, but now configured to be presented over conventional two transducer headphones.

Additionally, parallel reverberation processing may optionally be performed on one or more channels by reverberation circuit 15. In a free-field, the sound signal that reaches the ear includes information transmitted directly from each sound source as well as information reflected off of surfaces such as walls and ceilings. Sound information that is reflected off of surfaces is delayed in its arrival at the ear relative to sound that travels directly to the ear. In order to simulate surface reflection, at least one channel of the multi-channel signal would be routed to the reverberation circuit 15, as shown in FIG. 4.

In an exemplary embodiment of the present invention, one or more channels are routed through the reverberation circuit 15. The circuit 15 includes, for example, numerous lowpass comb filters in parallel configuration. This is illustrated in FIG. 16. The input channel is routed to lowpass comb filters 140, 141, 142, 143, 144 and 145. Each of these filters is designed, as is known in the art, to introduce the delays associated with reflection off of room surfaces. The output of the lowpass comb filters is summed at node 146 and passed through an allpass filter 147. The output of the allpass filter is separated into two channels, left and right. A gain, g, is applied to the left channel at node 147. An inverse gain, −g, is applied to the right channel at node 148. The gain g allows the relative proportions of direct and reverberated sounds to be adjusted.

FIG. 17 illustrates an exemplary embodiment of a lowpass comb filter 140. The input to the comb filter is summed with filtered output from the comb filter at node 150. The summed signal is routed through the comb filter 151 where it is delayed D samples. The output of the comb filter is routed to node 146, shown in FIG. 16, and also summed with feedback from the lowpass filter 153 loop at node 152. The summed signal is then input to the lowpass filter 153. The output of the lowpass filter 153 is then routed back through both the comb filter and the lowpass filter, with gains applied of $g_1$ and $g_2$ at nodes 154 and 155, respectively.

The effects of open-ear (non-obstructed) resonation are optionally added at circuit 29. The ear canal resonator according to the present invention is designed to simulate open-ear listening via headphones by introducing the resonances and anti-resonances that are characteristic of open-ear listening. It is generally known in the psychoacoustic art that open-ear listening introduces certain resonances and anti-resonances into the incoming acoustic signal due to the filtering effects of the outer ear. The characteristics of these resonances and anti-resonances are also generally known and may be used to construct a generally known transfer function, referred to as the open ear transfer function, that, when convolved with a digital signal, introduces these resonances and anti-resonances into the digital signal.

Open-ear resonation circuit 29 compensates for the effects introduced by obstruction of the outer ear via, for example, headphones. The open ear transfer function is convolved with each channel, left and right, using, for example, a digital signal processor. The output of the open-ear resonation circuit 29 is two audio channels 30, 31 that when delivered through headphones, simulate the listener's multi-loudspeaker listening experience by creating the sensation of phantom loudspeakers throughout the simulated room in accordance with loudspeaker layout provided by format of the multi-channel signal. Thus, the ear resonation circuit according to the present invention allows for use with any headphone, thereby eliminating a need for uniquely designed headphones.

Figure 5:
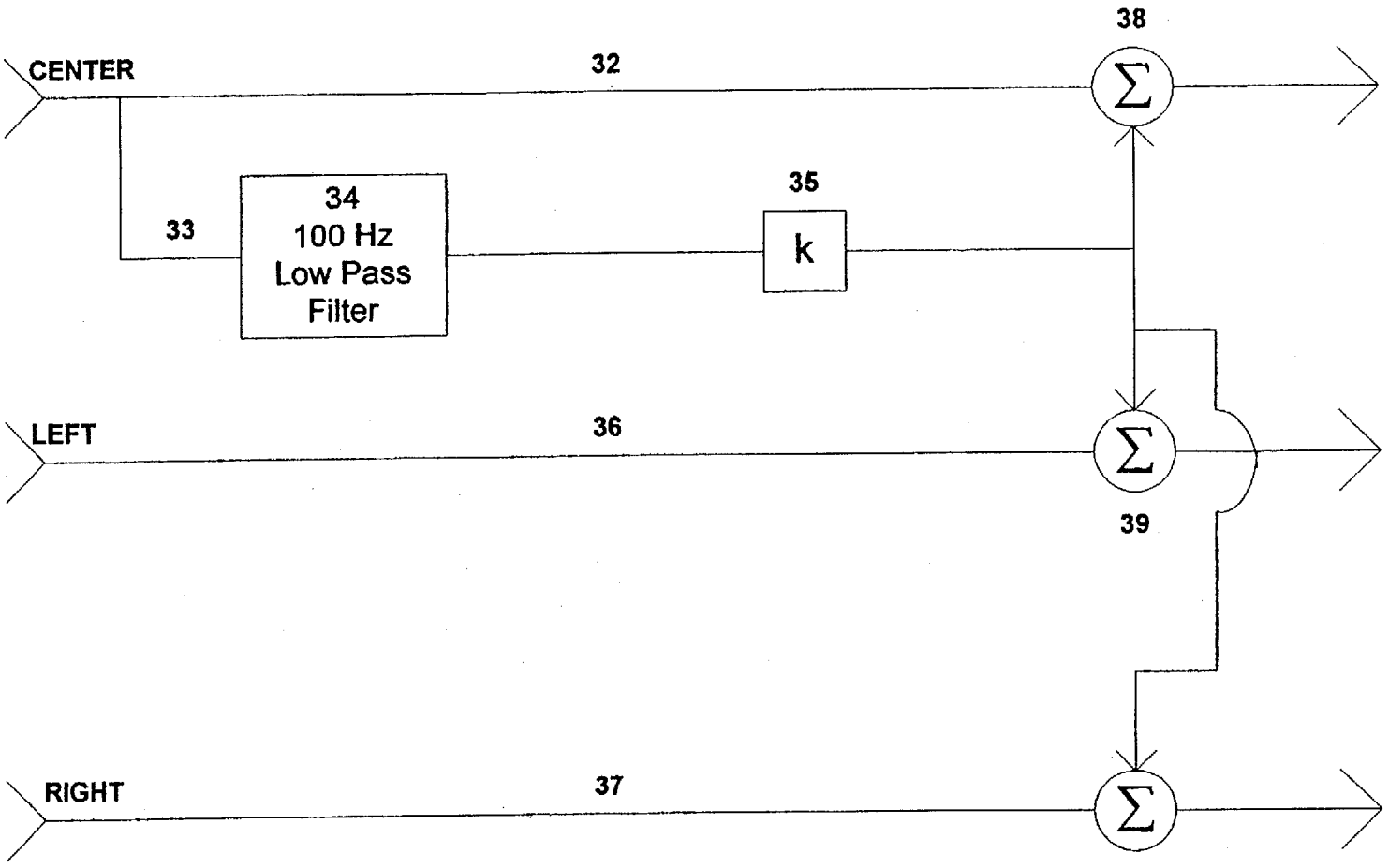
FIG. 5 is a schematic in block diagram form of a bass boost circuit according to an exemplary embodiment of the present invention.

Sound delivered to the ear via headphones is typically reduced in amplitude in the lower frequencies. Low frequency energy may be increased, however, through the use of a bass boost system. An exemplary embodiment of a bass boost circuit 6 is illustrated in FIG. 5. Output from selected channels of the multi-channel system is routed to the bass boost circuit 6. Low frequency signal information is extracted by performing a low-pass filter at, for example, 100 Hz on one or more channels, via low pass filter 34. Once the low frequency signal information is obtained, it is multiplied by predetermined factor 35, for example k, and added to all channels via summing circuits 38, 39 and 40, thereby boosting the low frequency energy present in each channel.

To create the sensation of multiple phantom loudspeakers over headphones, the HRTF coefficients associated with the location of each phantom loudspeaker relative to the listener must be convolved with each channel. This convolution is accomplished using a digital signal processor and may be done in either the time or frequency domains with filter order ranging from 16 to 32 taps. Because HRTFs differ for right and left ears, the single channel input to each HRTF processing circuit 10, 11, 12, 13 and 14 is processed in parallel by two separate HRTFs, one for the right ear and one for the left ear. The result is a dual channel (e.g., right and left ear) output. This process is illustrated in FIG. 6*a*.

Figure 6A:
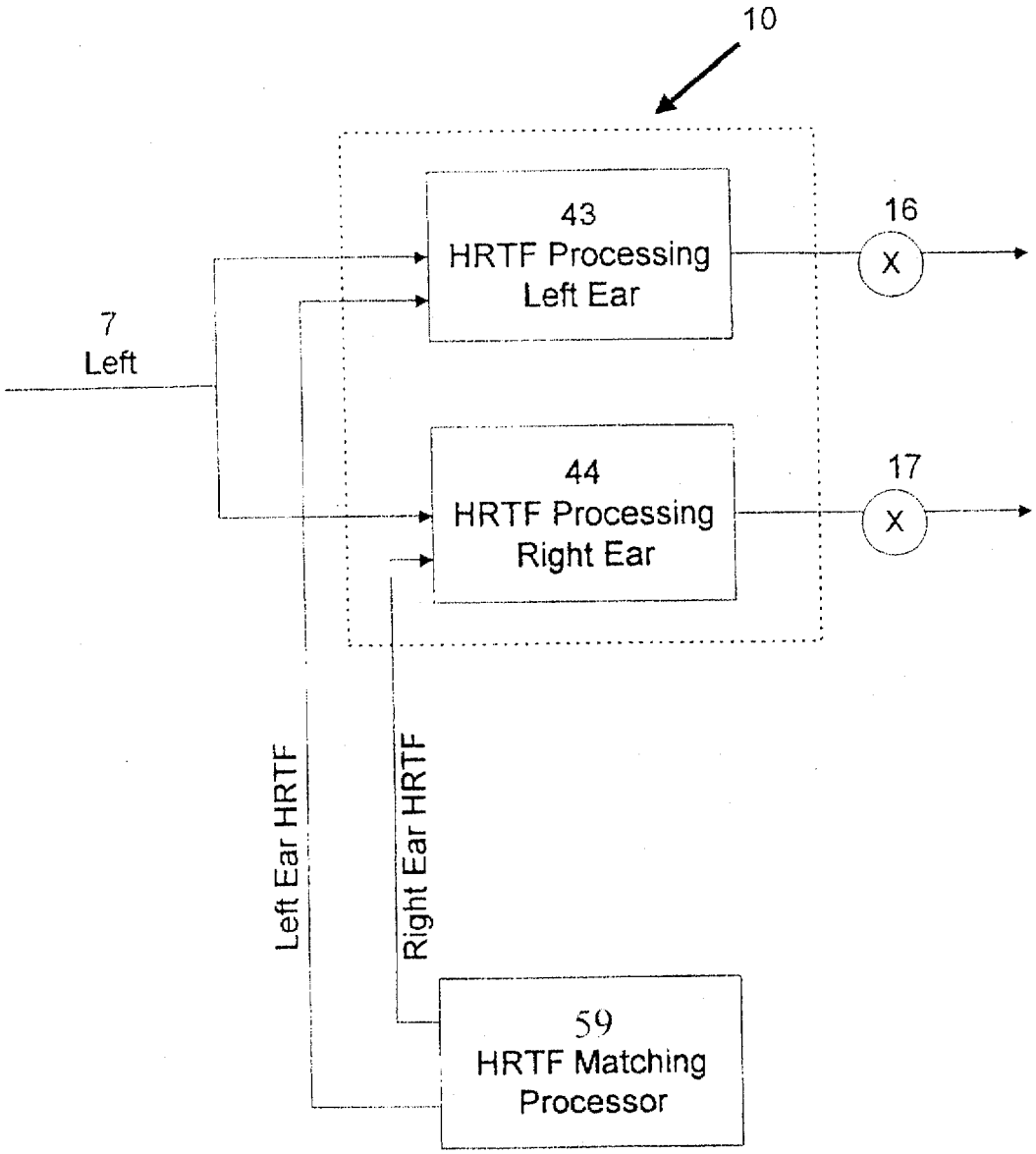

FIG. 6*a* illustrates the interaction of HRTF matching processor 59 with, for example, the HRTF processing circuit 10. Using the digital signal processor of HRTF processing circuit 10, the signal for each channel of the multi-channel signal is convolved with two different HRTFs. For example, FIG. 6*a* shows the left channel signal 7 being applied to the left and right HRTF processing circuits 43, 44 of the HRTF processing circuit 10. One set of HRTF coefficients corresponding to the spatial location of the phantom loudspeaker relative to the left ear is applied to signal 7 via left ear HRTF processing circuit 43, the other set of HRTF coefficients corresponding to the spatial location of the phantom loudspeaker relative to the right ear and being applied to signal 7 via the right ear HRTF processing circuit 44.

The HRTFs applied by HRTF processing circuits 43, 44 are selected from the set of HRTFs that best matches the listener via the HRTF matching processor 59. The output of each circuit 43, 44 is multiplied by a scaling factor via, for example, nodes 16 and 17, also as shown in FIG. 4. This scaling factor is used to apply signal attenuation that corresponds to that which would be achieved in a free field environment. The value of the scaling factor is inversely related to the distance between the phantom loudspeaker and the listener's ear. As shown in FIG. 4, the right ear output is summed for each phantom loudspeaker via node 26, and left ear output is summed for each phantom loudspeaker via node 27.

Prior to the selection of a best match HRTF by the listener, the present invention matches sample listeners to sets of HRTFs. This preliminary matching process includes: (1) collecting a database of sets of HRTFs; (2) ordering the HRTFs into a logical structure; and (3) storing the ordered sets of HRTFs in a ROM.

Figure 6B:
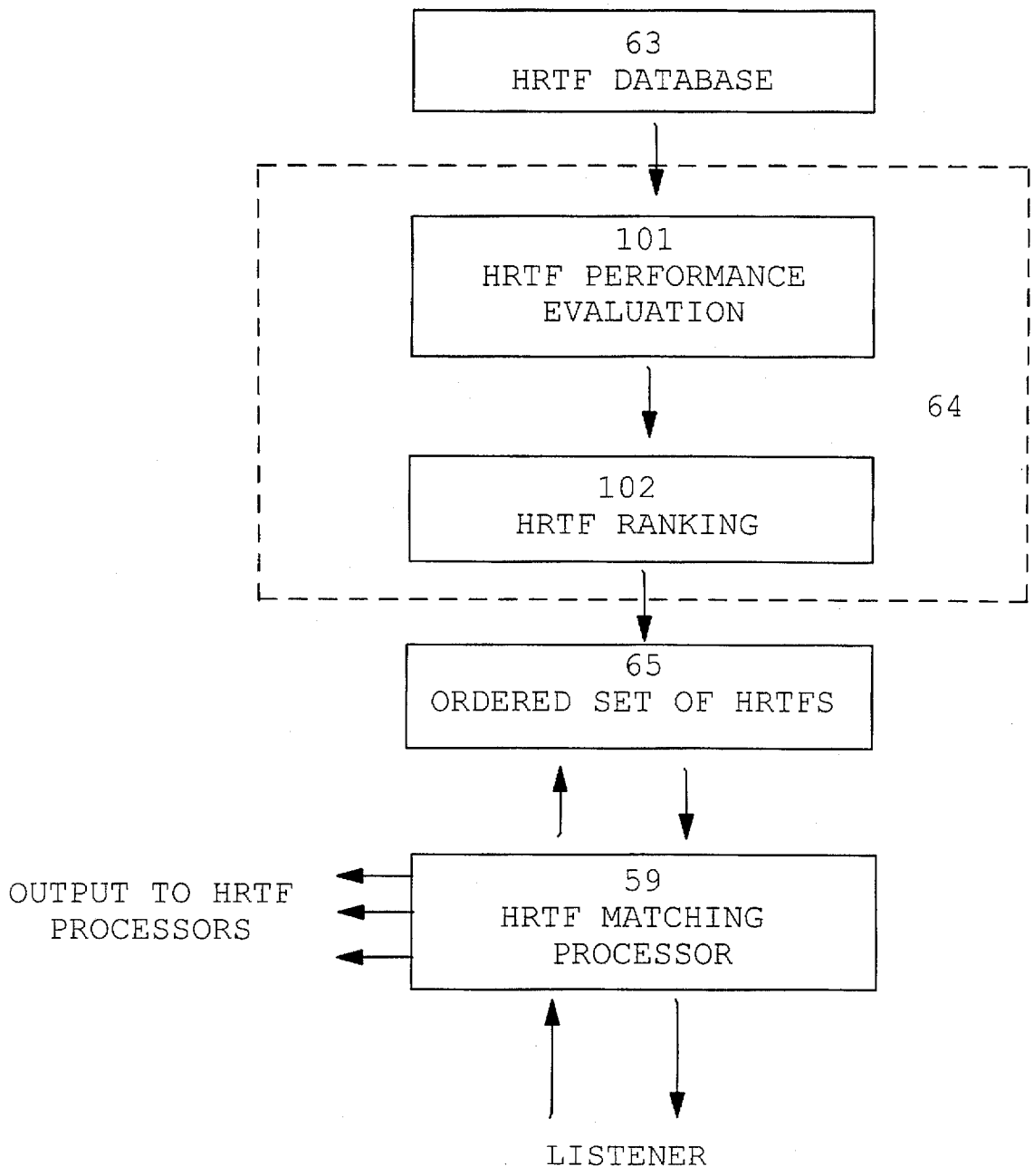
Figure 6C:
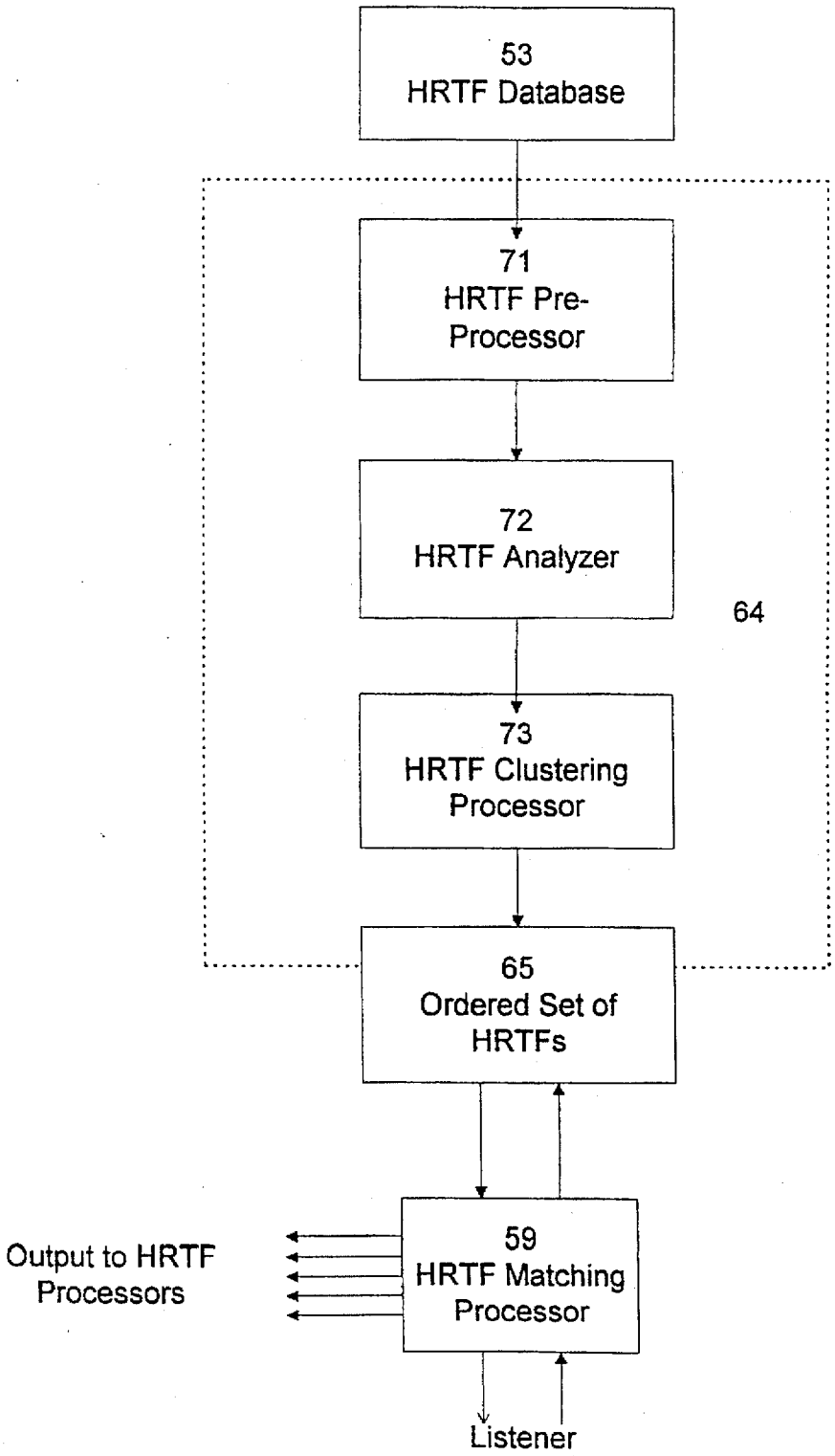

The HRTF database 63 shown in FIGS. 4, 6*a* and 6*c*, contains HRTF matching data and is obtained from a pre-measured group of the general population. For example, each individual of the pre-measured group is seated in the center of a sound-treated room. A robot arm can then locate a loudspeaker at various elevations and azimuths surrounding the individual. Using small transducers placed in each ear of the listener, the transfer function is obtained in response to sounds emitted from the loudspeaker at numerous positions. For example, HRTFs were recorded for each individual of the pre-measured group at each loudspeaker location for both the left and right ears. As described earlier, the spheres 110 shown in FIG. 3 illustrate typical HRTF locations. Each sphere 110 represents a set of HRTF coefficients describing the transfer function. Also as mentioned earlier, for each sphere 110, two HRTFs would be obtained, one for each ear. Thus, if HRTFs were obtained from S subjects, the total number of sets of HRTFs would be 2S. If for each subject and ear, HRTFs were obtained at L locations, the database 63 would consist of 2S * L HRTFs.

One HRTF matching procedure according to the present invention involves matching HRTFs to a listener using listener data that has already been ranked according to performance. The process of HRTF matching using listener performance rankings is illustrated in FIG. 6*b*. The present invention collects and stores sets of HRTFs from numerous individuals in an HRTF database 63 as described above. These sets of HRTFs are evaluated via a psychoacoustic procedure by the HRTF ordering processor 64, which, as shown in FIG. 6*b*, includes an HRTF performance evaluation block 101 and an HRTF ranking block 102.

Listener performance is determined via HRTF performance evaluation block 101. The sets of HRTFs are rank ordered based on listener performance and physical characteristics of the individual from whom the sets of HRTFs were measured via HRTF ranking block 102. The sets of HRTFs are then stored in an ordered manner in ROM 65 for subsequent use by a listener. From these ordered sets of HRTFs, the listener selects the set that best matches his own via HRTF matching processor 59. The set of HRTFs that best match the listener may include, for example the HRTFs for 25 different locations. The multi-channel signal may require, however, placement of phantom speakers at a limited number of predetermined locations, such as five in the Dolby Pro Logic® format. Thus, from the 25 HRTFs of the best match set of HRTFs, the five HRTFs closest to the predetermined locations for each channel of the multi-channel signal are selected and then input to their respective HRTF processor circuits 10 to 14 by the HRTF matching processor 59.

More particularly, prior to the use of headphones by a listener, the present invention employs a technique whereby sets of HRTFs are rated based on performance. Performance may be rated based on (1) ability to localize elevation; and/or (2) ability to localize front-back position. To rate performance, sample listeners are presented, through headphones, with sounds filtered using HRTFs associated with elevations either above or below the horizon. Azimuth position is randomized. The listener identifies whether the sound seems to be originating above the horizon or below the horizon. During each listening task, HRTFs obtained from, for example, eight individuals are tested in random order by various sample listeners. Using each set of HRTFs from the, for example, eight individuals, a percentage of correct responses of the sample listeners identifying the position of the sound is calculated. FIG. 7 illustrates this process. In FIG. 7, sound filtered using an HRTF associated with an elevation above the horizon has been presented to the listener via headphones. The listener has correctly identified the sound as coming from above the horizon.

This HRTF performance evaluation by the sample listeners results in a N by M matrix of performance ratings where N is the number of individuals from whom HRTFs were obtained and M is the number of listeners participating in the HRTF evaluation. A sample matrix is illustrated in FIG. 8. Each cell of the matrix represents the percentage of correct responses for a specific sample listener with respect to a specific set of HRTFs, i.e. one set of HRTFs from each individual, in this case eight individuals. The resulting data provide a means for ranking the HRTFs in terms of listeners' ability to localize elevation.

The present invention generally does not use performance data concerning listeners' ability to localize front-back position, primarily due to the fact that research has shown that many listeners who have difficulty localizing front-back position over headphones also have difficulty localizing front-back position in a free-field. Performance data on front-back localization in a free-field can be used, however, with the present invention.

According to one method for matching listeners to HRTFs, the present invention rank-orders sets of HRTFs contained in the database 63. FIG. 9 illustrates how, in a preferred embodiment of the present invention, sets of HRTFs are ranked-ordered based on performance as a function of height. There is a general correlation between height and HRTFs. For each set of HRTFs, the performance data for each listener is averaged, producing an average percent correct response. A gaussian distribution is applied to the HRTF sets. The x-axis of the distribution represents the relative heights of individuals from whom the HRTFs were obtained i.e., the eight individuals indicated in FIG. 8. The y-axis of the distribution represents the performance ratings of the HRTF sets. The HRTF sets are distributed such that HRTF sets with the highest performance ratings are located at the center of the distribution curve 47. The remaining HRTF sets are distributed about the center in a gaussian fashion such that as the distribution moves to the right, height increases. As the distribution moves to the left, height decreases.

The first method for matching listeners to HRTF sets utilizes a procedure whereby the user may easily select the HRTF sets that most closely match the user. For example, the listener is presented with sounds via headphones. The sound is filtered using numerous HRTFs from the ordered set of HRTFs stored in ROM 65. Each set of HRTFs are located at a fixed elevation while azimuth positions vary, encircling the head. The listener is instructed to "tune" the sounds until they appear to be coming from the lowest possible elevation. As the listener "tunes" the sounds, he or she is actually systematically stepping through the sets of HRTFs stored in the ROM 65.

First, the listener hears sounds filtered using the set of HRTFs located at the center of the performance distribution determined, for example, as shown in FIG. 9. Based on previous listener performance, this is most likely to be the best performing set of HRTFs. The listener may then tune the system up or down, via the HRTF matching processor 59, in an attempt to hear sounds coming from the lowest possible elevation. As the user tunes up, sets of HRTFs from taller individuals are used. As the user tunes down, sets of HRTFs from shorter individuals are used. The listener stops tuning when the sound seems to be originating from the lowest possible elevation. The process is illustrated in FIG. 10.

In FIG. 10, the upper circle of spheres 120 represents the perception of sound filtered using a set of HRTFs that does not fit the user well and thus the sound does not appear to be from a low elevation. The lower circle of spheres 130 represents the perception of sound filtered using a set of HRTFs chosen after tuning. The lower-circle of spheres 130 are associated with an HRTF set that is more closely matched to the listener and thus appears to be from a lower elevation. Once the listener has selected the best set of HRTFs, specific HRTFs are selected as a function of the desired phantom loudspeaker location associated with each of the multiple channels. These specific HRTFs are then routed to the HRTF processing circuits 10 to 14 for convolution with each channel of the multi-channel signal.

Another process of HRTF matching according to the present invention uses HRTF clustering as illustrated in FIG. 6*c*. As discussed above, the present invention collects and stores HRTFs from numerous individuals in the HRTF database 63. These HRTFs are pre-processed by the HRTF ordering processor 64 which includes an HRTF pre-processor 71, an HRTF analyzer 72 and an HRTF clustering processor 73. A raw HRTF is depicted in FIG. 11. The HRTF pre-processor 71 processes HRTFs so that they more closely match the way in which humans perceive sound, as described further below. The smoothed HRTFs are statistically analyzed, each one to every other one, to determine similarities and differences between them by HRTF analyzer 72. Based on the similarities and differences, the HRTFs are subjected to a cluster analysis, as is known in the art, by HRTF clustering processor 73, resulting in a hierarchical grouping of HRTFs. The HRTFs are then stored in an ordered manner in the ROM 65 for use by a listener. From these ordered HRTFs, the listener selects the set that provide the best match via the HRTF matching processor 59. From the set of HRTFs that best match the listener, the HRTFs appropriate for the location of each phantom speaker are input to their respective logical HRTF processing circuits 10 to 14.

A raw HRTF is depicted in FIG. 11 showing deep spectral notches common in a raw HRTF. In order to perform statistical comparisons of HRTFs from one individual to another, HRTFs must be processed so that they reflect the actual perceptual characteristics of humans. Additionally, in order to apply mathematical analysis, the deep spectral notches must be removed from the HRTF. Otherwise, due to slight deviations in the location of such notches, mathematical comparison of unprocessed HRTFs would be impossible.

The pre-processing of HRTFs by HRTF pre-processor 71 includes critical band filtering. The present invention filters HRTFs in a manner similar to that employed by the human auditory mechanism. Such filtering is termed critical band filtering, as is known in the art. Critical band filtering involves the frequency domain filtering of HRTFs using multiple filter functions known in the art that represent the filtering of the human hearing mechanism. In an exemplary embodiment, a gammatone filter is used to perform critical band filtering. The magnitude of the frequency response is represented by the function:

$$g(f)=1/(1+[(f-fc)^2/b^2])^2$$

where f is frequency, fc is the center frequency for the critical band and b is 1.019 ERB. ERB varies as a function of frequency such that ERB=24.7[4.37(fc/1000)+1]. For each critical band filter, the magnitude of the frequency response is calculated for each frequency, f, and is multiplied by the magnitude of the HRTF at that same frequency, f. For each critical band filter, the results of this calculation at all frequencies are squared and summed. The square root is then taken. This results in one value representing the magnitude of the internal HRTF for each critical band filter.

Such filtering results in a new set of HRTFs, the internal HRTF, that contain the information necessary for human listening. If, for example, the function 20 $\log_{10}$ is applied to the center frequency of each critical band filter, the frequency domain representation of the internal HRTF becomes a log spectrum that more accurately represents the perception of sound by humans. Additionally, the number of values needed to represent the internal HRTF is reduced from that needed to represent the unprocessed HRTF. An exemplary embodiment of the present invention applies critical band filtering to the set of HRTFs from each individual in the HRTF database 63, resulting in a new set of internal HRTFs. The process is illustrated in FIG. 12, wherein a raw HRTF 80 is filtered via a critical band filter 81 to produce the internal HRTF 82.

Application of critical band filtering results in, for example, N logarithmic frequency bands throughout the 4000 Hz to 18,000 Hz range. Thus, each HRTF may be described by N values. In one exemplary embodiment, N=18. In addition, HRTFs are obtained at L locations, for example, 25 locations. A set of HRTFs includes all HRTFs obtained in each location for each subject for each ear. Thus, one set of HRTFs includes L HRTFs, each described by N values. The entire set of HRTFs is defined by L * N values. The entire subject database is described as an S * (L * N) matrix, where S equals the number of subjects from which HRTFs were obtained. This matrix is illustrated in FIG. 13.

The statistical analysis of HRTFs performed by the HRTF analyzer 72, shown in FIG. 6*c*, is performed through computation of eigenvectors and eigenvalues. Such computations are known, for example, using the MATLAB® software program by The MathWorks, Inc. An exemplary embodiment of the present invention compares HRTFs by computing eigenvectors and eigenvalues for the set of 2S HRTFs at L * N levels. Each subject-ear HRTF set may be described by one or more eigenvalues. Only those eigenvalues computed from eigenvectors that contribute to a large portion of the shared variance are used to describe a set of subject-ear HRTFs. Each subject-ear HRTF may be described by, for example, a set of 10 eigenvalues.

The cluster analysis procedure performed by the HRTF clustering processor 73, shown in FIG. 6*c*, is performed using a hierarchical agglomerative cluster technique, for example the S-Plus® program complete line specifying a euclidian distance measure, provided by MathSoft, Inc., based on the distance between each set of HRTFs in multi-dimension space. Each subject-ear HRTF set is represented in multi-dimensional space in terms of eigenvalues. Thus, if 10 eigenvalues are used, each subject-ear HRTF would be represented at a specific location in 10-dimensional space. Distances between each subject-ear position are used by the cluster analysis in order to organize the subject-ear sets of HRTFs into hierarchical groups. Hierarchical agglomerative clustering in two dimensions is illustrated in FIG. 14. FIG. 15 depicts the same clustering procedure using a binary tree structure.

The present invention stores sets of HRTFs in an ordered fashion in the ROM 65 based on the result of the cluster analysis. According to the clustering approach to HRTF matching, the present invention employs an HRTF matching processor 59 in order to allow the user to select the set of HRTFs that best match the user. In an exemplary embodiment, an HRTF binary tree structure is used to match an individual listener to the best set of HRTFs. As illustrated in FIG. 15, at the highest level 48, the sets of HRTFs stored in the ROM 65 comprise one large cluster. At the next highest level 49, 50, the sets of HRTFs are grouped based on similarity into two sub-clusters. The listener is presented with sounds filtered using representative sets of HRTFs from each of two sub-clusters 49, 50. For each set of HRTFs, the listener hears sounds filtered using specific HRTFs associated with a constant low elevation and varying azimuths surrounding the head. The listener indicates which set of HRTFs appears to be originating at the lowest elevation. This becomes the current "best match set of HRTFs." The cluster in which this set of HRTFs is located becomes the current "best match cluster."

The "best match cluster" in turn includes two sub-clusters, 51, 52. The listener is again presented with a representative pair of sets of HRTFs from each sub-cluster. Once again, the set of HRTFs that is perceived to be of the lowest elevation is selected as the current "best match set of HRTFs" and the cluster in which it is found becomes the current "best match cluster." The process continues in this fashion with each successive cluster containing fewer and fewer sets of HRTFs. Eventually the process results in one of two conditions: (1) two groups containing sets of HRTFs so similar that there are no statistical significant differences within each group; or (2) two groups containing only one set of HRTFs. The representative set of HRTFs selected at this level becomes the listener's final "best match set of HRTFs." From this set of HRTFs, specific HRTFs are selected as a function of the desired phantom loudspeaker location associated with each of the multiple channels. These HRTFs are routed to multiple HRTF processors for convolution with each channel.

Also according to the present invention, both the method of matching listeners to HRTFs via listener performance and via cluster analysis can be applied, the results of each method being compared for cross-validation.

What is claimed is:

1. A method for processing a signal comprising at least one channel, wherein each channel has an audio component, wherein said method allows a user of headphones to receive at least one processed audio component and perceive that the sound associated with each of said at least one processed audio component has arrived from one of a plurality of positions, determined by said processing, wherein said method comprises the steps of:

a. receiving the audio component of each channel;

b. selecting, as a function of a user of headphones, a best-match set of head related transfer functions (HRTFs) from a database of sets of HRTFs;

c. processing the audio component of each channel via a corresponding pair of digital filters, said pairs of digital filters filtering said audio components as a function of the best-match set of HRTFs, each corresponding pair of digital filters generating a processed left audio component and a processed right audio component;

d. combining said processed left audio component from each channel of the signal to form a composite processed left audio component;

e. combining said processed right audio component from each channel of the signal to form a composite processed right audio component;

f. applying said composite processed left and right audio components to headphones, to create a virtual listening environment wherein said user of headphones perceives that the sound associated with each audio component has arrived from one of a plurality of positions, determined by said processing, wherein the step of selecting a best-match set of HRTFs further includes the step of matching the user to the best-match set of HRTFs from a method selected from the group consisting of listener performance and HRTF clustering, wherein the step of matching the user to the best-match set of HRTFs via listener performance further comprises the steps of:

i. providing, to the user, a sound signal filtered by a starting set of HRTFs, and ii. tuning the sound signal through at least one additional set of HRTFs, until the sound signal is tuned to a virtual position that approximates a predetermined virtual target position, thereby matching the user to the best-match set of HRTFs.

2. The method according to claim 1, wherein the starting set of HRTFs is a predetermined one of a rank-ordered set of HRTFs stored in an HRTF storage device.

3. The method according to claim 1, wherein the predetermined virtual target elevation is the lowest elevation heard by the user.

4. A method for processing a signal comprising at least one channel, wherein each channel has an audio component, wherein said method allows a user of headphones to receive at least one processed audio component and perceive that the sound associated with each of said at least one processed audio component has arrived from one of a plurality of positions, determined by said processing, wherein said method comprises the steps of:

a. receiving the audio component of each channel;

b. selecting, as a function of a user of headphones, a best-match set of head related transfer functions (HRTFs) from a database of sets of HRTFs;

c. processing the audio component of each channel via a corresponding pair of digital filters, said pairs of digital filters filtering said audio components as a function of the best-match set of HRTFs, each corresponding pair of digital filters generating a processed left audio component and a processed right audio component;

d. combining said processed left audio component from each channel of the signal to form a composite processed left audio component;

e. combining said processed right audio component from each channel of the signal to form a composite processed right audio component:

f. applying said composite processed left and right audio components to headphones, to create a virtual listening environment wherein said user of headphones perceives that the sound associated with each audio component has arrived from one of a plurality of positions, determined by said processing, wherein the step of selecting a best-match set of HRTFs further includes the step of matching the user to the best-match set of HRTFs from a method selected from the group consisting of listener performance and HRTF clustering, wherein the step of matching the user to the best-match HRTF set via HRTF clustering further comprises the steps of:

i. performing cluster analysis on the database of HRTF sets based on the similarities among the HRTF sets to order the HRTF sets into a clustered structure, wherein there is defined a highest level cluster containing all the sets of HRTFs stored in the database, wherein each cluster of HRTF sets contains either one HRTF set, only HRTF sets which have no statistical difference between them, or a plurality of sub-clusters of HRTF sets;

ii. selecting a representative HRTF set from each one of a plurality of sub-clusters of the highest level cluster of HRTF sets;

iii. selecting a subset of HRTFs from each representative HRTF set, wherein each subset of HRTFs is associated with a predetermined virtual target position;

iv. providing, to the user, a plurality of sound signals, each of said plurality of sound signals being filtered by one of said plurality of subsets of HRTFs;

v. selecting, by the user, one of said plurality of sound signals as a function of said predetermined virtual target position, the selected sound signal corresponding to the best-match cluster, wherein the representative HRTF set of the best-match cluster defines the best-match HRTF set.

5. The method according to claim 4, wherein each selected representative HRTF set most exemplifies the similarities between the HRTF sets within the cluster of HRTF sets from which the representative HRTF set is selected.

6. The method according to claim 4, wherein the step of matching the listener to the best-match HRTF set via HRTF clustering further comprises the steps of:

a. after selecting, by the user, one of said plurality of sound signals as a function of said predetermined virtual target position, selecting a representative HRTF set from each sub-cluster of the best-match cluster;

b. selecting a subset of HRTFs from each representative HRTF set of each sub-cluster of the best-match cluster, wherein each subset of HRTFs is associated with a predetermined virtual target position;

c. providing, to the user, a plurality of sound signals, each of said plurality of sound signals filtered with one of said plurality of subsets of HRTFs corresponding to the plurality of sub-clusters of the best-match cluster;

d. selecting one of said plurality of sound signals as a function of a predetermined virtual target position, the selected sound signal corresponding to the best-match cluster, wherein the representative HRTF set of the best-match cluster defines the best-match HRTF set;

e. repeating steps a through d until the best-match cluster contains only one HRTF set or contains only HRTF sets which have no statistical difference between them.

7. A method for processing a signal comprising at least one channel, wherein each channel has an audio component, wherein said audio component of each channel is a Dolby Pro Logic® audio component, wherein said method allows a user of headphones to receive at least one processed audio component and perceive that the sound associated with each audio component has arrived from one of a plurality of positions, determined by said processing, wherein said method comprises the steps of:

a. receiving the audio component of each channel;

b. processing the audio component of at least one channel via a bass boost circuit;

c. selecting, as a function of a user of headphones, a best-match set of head related transfer functions (HRTFs) from a database of sets of HRTFs, said database having been generated by measuring and recording sets of HRTFs of a representative sample of the listening population:

d. processing the audio component of each channel via a pair of digital filters, the pair of digital filters filtering the audio component of each channel as a function of the best-match set of HRTFs, the pair of digital filters generating a processed left audio component and a processed right audio component;

e. combining said processed left audio component from each channel of the signal to form a composite processed left audio component;

f. combining said processed right audio component from each channel of the signal to form a composite processed right audio component;

g. processing the composite processed left audio component and the composite processed right audio component via an ear canal resonator circuit;

h. applying said composite processed left and right audio components to headphones, to create a virtual listening environment wherein the user of headphones perceives that the sound associated with each audio component has arrived from one of a plurality of positions, determined by said processing;

wherein the step of selecting a best-match set of HRTFs further comprises selecting a subset of HRTFs from the best-match set of HRTFs, each of the selected HRTFs of said subset of HRTFs being selected so as to correspond to a virtual position closest to one of said plurality of positions so that the user of headphones perceives that the sound associated with each channel originates from or near to one of said plurality of said positions, wherein the step of selecting a best-match set of HRTFs further includes the step of matching the user to the best-match set of HRTFs via HRTF clustering, wherein the step of matching the user to the best-match HRTF set via HRTF clustering further comprises the steps of:

i. performing cluster analysis on the database of HRTF sets based on the similarities among the HRTF sets to order the HRTF sets into a clustered structure, wherein there is defined a highest level cluster containing all the sets of HRTFs stored in the database, wherein each cluster of HRTF sets contains either one HRTF set, only HRTF sets which have no statistical difference between them, or a plurality of sub-clusters of HRTF sets;

ii. selecting a representative HRTF set from each one of a plurality of sub-clusters of the highest level cluster of HRTF sets;

iii. selecting a subset of HRTFs from each representative HRTF set, wherein each subset of HRTFs is associated with a predetermined virtual target position;

iv. providing, to the user, a plurality of sound signals, each of said plurality of sound signals being filtered by one of said plurality of subsets of HRTFs;

v. selecting, by the user, one of said plurality of sound signals as a function of said predetermined virtual target position, the selected sound signal corresponding to the best-match cluster, wherein the representative HRTF set of the best-match cluster defines the best-match HRTF set.

8. The method, according to claim 7, wherein each selected representative HRTF set most exemplifies the similarities between the HRTF sets within the cluster of HRTF sets from which the representative HRTF set is selected.

9. The method, according to claim 8, wherein the step of matching the listener to the best-match HRTF set via HRTF clustering further comprises the steps of:

a. after selecting, by the user, one of said plurality of sound signals as a function of said predetermined virtual target position, selecting a representative HRTF set from each sub-cluster of the best-match cluster;

b. selecting a subset of HRTFs from each representative HRTF set of each sub-cluster of the best-match cluster, wherein each subset of HRTFs is associated with a predetermined virtual target position;

c. providing, to the user, a plurality of sound signals, each of said plurality of sound signals filtered with one of said plurality of subsets of HRTFs corresponding to the plurality of sub-clusters of the best-match cluster;

d. selecting one of said plurality of sound signals as a function of a predetermined virtual target position, the selected sound signal corresponding to the best-match cluster, wherein the representative HRTF set of the best-match cluster defines the best-match HRTF set;

e. repeating steps a through d until the best-match cluster contains only one HRTF set or contains only HRTF sets which have no statistical difference between them.

* * * * *